US010273759B2

(12) United States Patent
Ricks et al.

(10) Patent No.: US 10,273,759 B2
(45) Date of Patent: Apr. 30, 2019

(54) SELF-ADJUSTING EARTH-BORING TOOLS AND RELATED SYSTEMS AND METHODS

(71) Applicant: Baker Hughes Incorporated, Houston, TX (US)

(72) Inventors: Gregory L. Ricks, Spring, TX (US); Chaitanya K. Vempati, Conroe, TX (US); Jayesh Rameshlal Jain, The Woodlands, TX (US); Juan Miguel Bilen, The Woodlands, TX (US); Anthony Phillips, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 562 days.

(21) Appl. No.: 14/972,635

(22) Filed: Dec. 17, 2015

(65) Prior Publication Data

US 2017/0175454 A1 Jun. 22, 2017

(51) Int. Cl.

| | |
|---|---|
| ***E21B 10/42*** | (2006.01) |
| ***E21B 10/62*** | (2006.01) |
| ***E21B 10/633*** | (2006.01) |

(52) U.S. Cl.

CPC ..... *E21B 10/62* (2013.01); *E21B 10/42* (2013.01); *E21B 10/633* (2013.01)

(58) Field of Classification Search

CPC ..... E21B 10/42; E21B 10/62; E21B 10/633
See application file for complete search history.

(56) References Cited

U.S. PATENT DOCUMENTS

| | | | |
|---|---|---|---|
| 1,612,338 | A | 12/1926 | Wilson et al. |
| 2,815,932 | A | 12/1957 | Wolfram |
| 3,050,122 | A | 8/1962 | Huitt |
| 3,422,672 | A | 1/1969 | Payne |

(Continued)

FOREIGN PATENT DOCUMENTS

| | | | |
|---|---|---|---|
| WO | 2005097383 | A1 | 10/2005 |
| WO | 2009134842 | A2 | 11/2009 |

(Continued)

OTHER PUBLICATIONS

Jain, Jayesh Rmeshlal, U.S. Appl. No. 14/851,117 entitled Actively Controlled Self-Adjusting Bits and Related Systems and Methods, filed Sep. 11, 2015.

(Continued)

*Primary Examiner* — Matthew R Buck
(74) *Attorney, Agent, or Firm* — TraskBritt

(57) ABSTRACT

A self-adjusting earth-boring tool includes a body carrying cutting elements and an actuation device disposed at least partially within the body. The actuation device may include a first fluid chamber, a second fluid chamber, a first reciprocating member, and a second reciprocating member. The first and second reciprocating members may divide portions of the first fluid chamber from portions of the second fluid chamber. A connection member may be attached to both of the first and second reciprocating members and may have a drilling element removably coupled thereto. A first fluid flow path may extend from the second fluid chamber to the first fluid chamber. A second fluid flow path may extend from the first fluid chamber to the second fluid chamber.

20 Claims, 5 Drawing Sheets

(56) References Cited

U.S. PATENT DOCUMENTS 3,583,501 A 6/1971 Aalund
4,375,239 A 3/1983 Barrington et al.
4,386,669 A 6/1983 Evans
4,662,458 A 5/1987 Ho
4,856,601 A 8/1989 Raney
5,042,596 A 8/1991 Brett et al.
5,553,678 A 9/1996 Barr et al.
5,842,149 A 11/1998 Harrell et al.
5,967,247 A 10/1999 Pessier
6,021,377 A 2/2000 Dubinsky et al.
6,123,160 A 9/2000 Tibbitts
6,142,250 A 11/2000 Griffin et al.
6,157,893 A 12/2000 Berger et al.
6,173,797 B1 1/2001 Dykstra et al.
6,209,664 B1 4/2001 Amaudric Du Chaffaut
6,253,863 B1 7/2001 Mensa-Wilmot et al.
6,338,390 B1 * 1/2002 Tibbitts ..... E21B 7/24 175/381
6,349,780 B1 2/2002 Beuershausen
6,484,822 B2 11/2002 Watson et al.
6,484,825 B2 11/2002 Watson et al.
6,732,817 B2 5/2004 Dewey et al.
6,785,641 B1 8/2004 Huang
6,880,650 B2 4/2005 Hoffmaster et al.
6,971,459 B2 12/2005 Raney
7,201,237 B2 4/2007 Raney
7,314,099 B2 1/2008 Dewey et al.
7,392,857 B1 7/2008 Hall et al.
7,419,016 B2 9/2008 Hall et al.
7,424,922 B2 9/2008 Hall et al.
7,430,153 B2 9/2008 Fraser et al.
7,451,836 B2 11/2008 Hoffmaster et al.
7,451,837 B2 11/2008 Hoffmaster et al.
7,493,971 B2 2/2009 Nevlud et al.
7,523,792 B2 4/2009 El-Rayes et al.
7,533,737 B2 5/2009 Hall et al.
7,571,780 B2 8/2009 Hall et al.
7,594,552 B2 9/2009 Radford et al.
7,641,002 B2 1/2010 Hall et al.
7,661,490 B2 2/2010 Raney
7,721,823 B2 5/2010 Radford
7,730,975 B2 6/2010 Hall et al.
7,845,430 B2 12/2010 Johnson et al.
7,849,939 B2 12/2010 Downton et al.
7,866,413 B2 1/2011 Stauffer et al.
7,882,905 B2 2/2011 Radford et al.
7,921,937 B2 4/2011 Brackin et al.
7,971,661 B2 7/2011 Johnson et al.
7,971,662 B2 7/2011 Beuershausen
8,061,455 B2 11/2011 Beuershausen
8,087,479 B2 1/2012 Kulkarni et al.
8,205,686 B2 6/2012 Beuershausen
8,205,689 B2 6/2012 Radford
8,240,399 B2 8/2012 Kulkarni et al.
8,281,882 B2 10/2012 Hall et al.
8,302,703 B2 11/2012 Rolovic
8,443,875 B2 5/2013 Lee
8,453,763 B2 6/2013 Radford et al.
8,511,946 B2 8/2013 Woodruff et al.
8,534,384 B2 9/2013 Beuershausen et al.
8,739,884 B2 6/2014 Lake
8,746,368 B2 6/2014 Johnson et al.
8,763,726 B2 7/2014 Johnson et al.
8,768,726 B1 7/2014 Cave
8,813,871 B2 8/2014 Radford et al.
8,925,654 B2 1/2015 Zahradnik
8,950,517 B2 2/2015 Hall et al.
8,960,329 B2 2/2015 Downton
9,080,399 B2 7/2015 Oesterberg
9,103,175 B2 8/2015 Schwefe
9,140,074 B2 9/2015 Schwefe et al.
9,181,756 B2 11/2015 Schwefe et al.
9,187,960 B2 11/2015 Radford et al.
9,255,449 B2 2/2016 Schwefe et al.
9,255,450 B2 2/2016 Jain et al.
9,267,329 B2 2/2016 Bilen
9,279,293 B2 3/2016 Izbinski
9,359,826 B2 6/2016 Do et al.
9,399,892 B2 7/2016 Do et al.
9,611,697 B2 4/2017 Radford et al.
9,663,995 B2 5/2017 Jain
9,677,344 B2 6/2017 Radford et al.
9,708,859 B2 7/2017 Jain et al.
9,759,014 B2 9/2017 Do et al.
9,915,138 B2 3/2018 Schwefe et al.
9,932,780 B2 4/2018 Spencer et al.
9,970,239 B2 5/2018 Oesterberg
10,000,977 B2 6/2018 Jain et al.
10,001,005 B2 6/2018 Schwefe et al.
10,041,305 B2 8/2018 Jain
2003/0146305 A1 8/2003 Gurich
2003/0166470 A1 9/2003 Fripp et al.
2005/0096847 A1 5/2005 Huang
2007/0114065 A1 5/2007 Hall
2007/0221416 A1 9/2007 Hall et al.
2007/0272445 A1 11/2007 Cariveau et al.
2008/0000693 A1 1/2008 Hutton
2008/0041593 A1 * 2/2008 Brown ..... E21B 36/001 166/302
2009/0044979 A1 2/2009 Johnson et al.
2009/0097985 A1 4/2009 Lea-Wilson
2009/0107722 A1 4/2009 Chen et al.
2009/0133931 A1 5/2009 Rolovic
2009/0183790 A1 7/2009 Moore
2010/0038141 A1 2/2010 Johnson et al.
2010/0071956 A1 3/2010 Beuershausen
2010/0157735 A1 6/2010 Allan et al.
2010/0212964 A1 8/2010 Beuershausen
2010/0270085 A1 10/2010 Turner et al.
2011/0155473 A1 6/2011 Raney
2012/0106297 A1 5/2012 Fraser
2012/0255788 A1 10/2012 Schwefe et al.
2012/0318580 A1 * 12/2012 Oesterberg ..... E21B 7/064 175/57
2013/0025358 A1 1/2013 Radford et al.
2013/0081880 A1 4/2013 Schwefe et al.
2013/0180784 A1 7/2013 Esko et al.
2014/0311801 A1 * 10/2014 Jain ..... E21B 10/62 175/27
2014/0332271 A1 11/2014 Do et al.
2014/0332283 A1 11/2014 Do et al.
2014/0356419 A1 12/2014 Gujral et al.
2015/0191979 A1 * 7/2015 Jain ..... E21B 10/54 175/57
2016/0032658 A1 2/2016 Jain
2016/0053551 A1 2/2016 Jain et al.
2016/0123355 A1 5/2016 Collins
2016/0138353 A1 5/2016 Ruttley et al.
2016/0258224 A1 9/2016 Do et al.
2017/0074047 A1 3/2017 Jain
2017/0159370 A1 6/2017 Evans et al.
2017/0175454 A1 6/2017 Ricks et al.
2017/0175455 A1 6/2017 Jain et al.
2017/0234071 A1 8/2017 Spatz et al.
2017/0268312 A1 9/2017 Haake
2017/0335631 A1 11/2017 Eddison
2017/0362898 A1 12/2017 Do et al.
2018/0128060 A1 5/2018 Haugvaldstad
2018/0179826 A9 6/2018 Jain et al.

FOREIGN PATENT DOCUMENTS

WO 2013/160188 A1 10/2013
WO 2016/187372 A1 11/2016
WO 2017044763 A1 3/2017
WO 2017/106605 A1 6/2017
WO 2017/132033 A1 8/2017
WO 2017/142815 A1 8/2017

OTHER PUBLICATIONS

Jain, Jayesh R., Drill Bit with Self-Adjusting Gage Pads, U.S. Appl. No. 14/516,069, filed Oct. 16, 2014.

(56) References Cited

OTHER PUBLICATIONS

Jain et al., Mitigation of Torsional Stick-Slip Vibrations in Oil Well Drilling Through PCD Bit Design: Putting Theories to the Test, SPE 146561, Soiciet of Petroleum Engineers, 2011, pp. 1-13.
Jain et al., Modeling and Simulation of Drill Strings with Adaptive Systems, U.S. Appl. No. 14/516,203 dated Oct. 16, 2014.
Jain et al., U.S. Appl. No. 14/973,282, Earth-Boring Tools Including Passively Adjustable, Agressiveness-Modifying Members and Related Methods, filed Dec. 17, 2015.
International Search Report for International Application No. PCT/US2016/066656 dated Mar. 28, 2017, 6 pages.
International Written Opinion for International Application No. PCT/US2016/066656 dated Mar. 28, 2017, 13 pages.

* cited by examiner

SELF-ADJUSTING EARTH-BORING TOOLS AND RELATED SYSTEMS AND METHODS

CROSS-REFERENCE TO RELATED APPLICATIONS

This application is related to U.S. patent application Ser. No. 13/864,926, to Jain et al., filed Apr. 17, 2013, now U.S. Pat. No. 9,255,450, issued Feb. 9, 2016; to U.S. patent application Ser. No. 14/851,117, to Jain, filed Sep. 11, 2015, now U.S. Pat. No. 10,041,305, issued Aug. 7, 2018, and to U.S. patent application Ser. No. 14/973,282, to Jain et al., filed Dec. 17, 2015, now U.S. Pat. No. 10,094,174, issued Oct. 9, 2018, the disclosure of each of which is hereby incorporated herein in its entirety by this reference.

TECHNICAL FIELD

This disclosure relates generally to self-adjusting earth-boring tools for use in drilling wellbores, to bottom-hole assemblies and systems incorporating self-adjusting earth-boring tools, and to methods and using such self-adjusting earth-boring tools, assemblies, and systems.

BACKGROUND

Oil wells (wellbores) are usually drilled with a drill string. The drill string includes a tubular member having a drilling assembly that includes a single drill bit at its bottom end. The drilling assembly typically includes devices and sensors that provide information relating to a variety of parameters relating to the drilling operations ("drilling parameters"), behavior of the drilling assembly ("drilling assembly parameters") and parameters relating to the formations penetrated by the wellbore ("formation parameters"). A drill bit and/or reamer attached to the bottom end of the drilling assembly is rotated by rotating the drill string from the drilling rig and/or by a drilling motor (also referred to as a "mud motor") in the bottom-hole assembly ("BHA") to remove formation material to drill the wellbore. A large number of wellbores are drilled along non-vertical, contoured trajectories in what is often referred to as directional drilling. For example, a single wellbore may include one or more vertical sections, deviated sections and horizontal sections extending through differing types of rock formations.

When drilling with a fixed-cutter, or so-called "drag" bit or other earth-boring tool progresses from a soft formation, such as sand, to a hard formation, such as shale, or vice versa, the rate of penetration ("ROP") changes, and excessive ROP fluctuations and/or vibrations (lateral or torsional) may be generated in the drill bit. The ROP is typically controlled by controlling the weight-on-bit ("WOB") and rotational speed (revolutions per minute or "RPM") of the drill bit. WOB is controlled by controlling the hook load at the surface and RPM is controlled by controlling the drill string rotation at the surface and/or by controlling the drilling motor speed in the drilling assembly. Controlling the drill bit vibrations and ROP by such methods requires the drilling system or operator to take actions at the surface. The impact of such surface actions on the drill bit fluctuations is not substantially immediate. Drill bit aggressiveness contributes to the vibration, whirl and stick-slip for a given WOB and drill bit rotational speed. "Depth of Cut" ("DOC") of a fixed-cutter drill bit, is generally defined as a distance a bit advances into a formation over a revolution, is a significant contributing factor relating to the drill bit aggressiveness. Controlling DOC can prevent excessive formation material buildup on the bit (e.g., "bit balling,"), limit reactive torque to an acceptable level, enhance steerability and directional control of the bit, provide a smoother and more consistent diameter borehole, avoid premature damage to the cutting elements, and prolong operating life of the drill bit.

BRIEF SUMMARY

In some embodiments, the present disclosure includes an earth-boring tool that includes a body, an actuation device disposed at least partially within the body, and a drilling element. The actuation device may include a first fluid chamber, a second fluid chamber, a first reciprocating member configured to reciprocate back and forth within the first fluid chamber and the second fluid chamber, the first reciprocating member having a front surface and a back surface, a second reciprocating member configured to reciprocate back and forth within the first fluid chamber and the second fluid chamber, a hydraulic fluid disposed within and at least substantially filling the first fluid chamber and the second fluid chamber, and a connection member attached to the first reciprocating member and extending through the second reciprocating member and out of the second fluid chamber. The drilling element may be removably coupled to the connection member of the actuation device.

In some embodiments, the present disclosure includes an earth-boring tool including a body, an actuation device disposed at least partially within the body, and a drilling element assembly. The actuation device may include a first fluid chamber, a second fluid chamber, at least one reciprocating member dividing the first fluid chamber from the second fluid chamber, the at least one reciprocating member configured to reciprocate back and forth within the first fluid chamber and the second fluid chamber, and a connection member attached to the reciprocating member at a portion of the reciprocating member facing the second fluid chamber, the connection member extending out of the second fluid chamber. The drilling element assembly may be removably coupled to a longitudinal end of the connection member extending out of the second fluid chamber.

In some embodiments, the present disclosure includes an actuation device for a self-adjusting earth-boring tool. The actuation device may include a first fluid chamber having a first portion and a second portion, a second fluid chamber having a first portion and a second portion, a first reciprocating member sealingly dividing the first portion of the first fluid chamber from the first portion of the second fluid chamber, a second reciprocating member sealingly dividing the second portion of the second fluid chamber from the second portion of the second fluid chamber, a connection member attached to a back surface of the first reciprocating member facing the first portion of the second fluid chamber, the connection member further attached to and extending through the second reciprocating member and out of the second portion of the second fluid chamber, a pressure compensator in fluid communication with the second fluid chamber, and a drilling element attached to the connection member.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
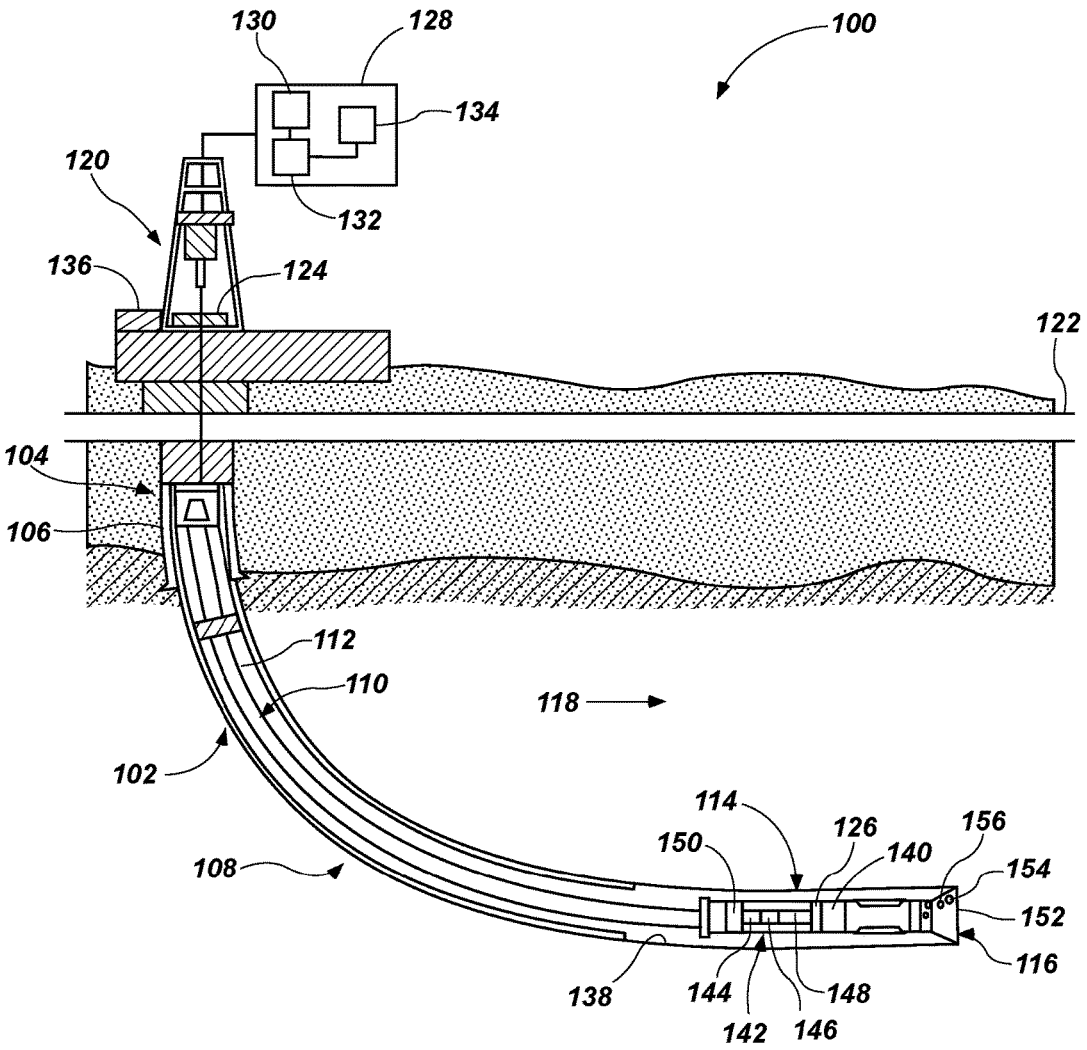
FIG. 1 is a schematic diagram of a wellbore system comprising a drill string that includes a self-adjusting drill bit according to an embodiment of the present disclosure.

The illustrations presented herein are not actual views of any particular drilling system, drilling tool assembly, or component of such an assembly, but are merely idealized representations, which are employed to describe the present invention.

As used herein, the terms "bit" and "earth-boring tool" each mean and include earth boring tools for forming, enlarging, or forming and enlarging a wellbore. Non-limiting examples of bits include fixed-cutter (drag) bits, fixed-cutter coring bits, fixed-cutter eccentric bits, fixed-cutter bicenter bits, fixed-cutter reamers, expandable reamers with blades bearing fixed cutters, and hybrid bits including both fixed cutters and movable cutting structures (roller cones).

As used herein, the term "fixed cutter" means and includes a cutting element configured for a shearing cutting action, abrasive cutting action or impact (percussion) cutting action and fixed with respect to rotational movement in a structure bearing the cutting element, such as, for example, a bit body, a tool body, or a reamer blade, without limitation.

As used herein, the terms "wear element" and "bearing element" respectively mean and include elements mounted to an earth-boring tool and which are not configured to substantially cut or otherwise remove formation material when contacting a subterranean formation in which a wellbore is being drilled or enlarged.

As used herein, the term "drilling element" means and includes fixed cutters, wear elements, and bearing elements. For example, drilling elements may include cutting elements, pads, elements making rolling contact, elements that reduce friction with formations, PDC bit blades, cones, elements for altering junk slot geometry, etc.

As used herein, any relational term, such as "first," "second," "front," "back," etc., is used for clarity and convenience in understanding the disclosure and accompanying drawings, and does not connote or depend on any specific preference or order, except where the context clearly indicates otherwise.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Some embodiments of the present disclosure include self-adjusting drill bits for use in a wellbore. For example, a self-adjusting drill bit may include an actuation device for extending and retracting a drilling element (e.g., a cutting element) of the bit. The drilling element may be attached to a connection member, which is attached to at least two reciprocating members within the actuation device. The reciprocating members may extend and retract the drilling element by moving through inward and outward strokes. The actuation device may include a first fluid chamber and a second fluid chamber. The first fluid chamber may have a pressure higher than the pressure of the second fluid chamber. Furthermore, the first fluid chamber may have a first portion located to apply a pressure on a first reciprocating member and a second portion located to apply the pressure on a second reciprocating member. Thus, because the pressure is applied to a first surface of the first reciprocating member and a second surface of the second reciprocating member, a surface area of each of the first and second surfaces may be smaller while providing a same force on the connection member from the pressure. Some embodiments of the present disclosure include an actuation device for a self-adjusting drill bit that includes a removable drilling element. Furthermore, some embodiments of the present disclosure include an actuation device having a pressure compensator for balancing an environment pressure with a pressure of the second fluid chamber. In some embodiments, the pressure compensator may include a rubber material.

FIG. 1 is a schematic diagram of an example of a drilling system 100 that may utilize the apparatuses and methods disclosed herein for drilling wellbores. FIG. 1 shows a wellbore 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing. A drill bit 116 may be attached to the bottom end of the drilling assembly 114 for drilling the wellbore 102 of a selected diameter in a formation 118.

The drill string 110 may extend to a rig 120 at the surface 122. The rig 120 shown is a land rig 120 for ease of explanation. However, the apparatuses and methods disclosed equally apply when an offshore rig 120 is used for drilling wellbores under water. A rotary table 124 or a top drive may be coupled to the drill string 110 and may be utilized to rotate the drill string 110 and to rotate the drilling assembly 114, and thus the drill bit 116 to drill the wellbore 102. A drilling motor 126 (also referred to as "mud motor") may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the wellbore 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth formation/lithology, etc. In some embodiments, the surface control unit 128 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a Flash memory, a magnetic tape, a hard disk, and an optical disk. During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside wall 138 of the wellbore 102.

The drilling assembly 114 may further include one or more downhole sensors 140 (collectively designated by numeral 140). The sensors 140 may include any number and type of sensors 140, including, but not limited to, sensors 140 generally known as the measurement-while-drilling (MWD) sensors 140 or the logging-while-drilling (LWD) sensors 140, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank and/or crown of a bit body of the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 via a two-way telemetry unit 150.

The drill bit 116 may include a face section 152 (or bottom section). The face section 152 or a portion thereof may face the undrilled formation 118 in front of the drill bit 116 at the wellbore 102 bottom during drilling. In some embodiments, the drill bit 116 may include one or more cutting elements that may be extended and retracted from a surface, such as a surface over the face section 152, of the drill bit 116 and, more specifically, a blade projecting from the face section 152. An actuation device 156 may control the rate of extension and retraction of the drilling element 154 with respect to the drill bit 116. In some embodiments, the actuation device 156 may be a passive device that automatically adjusts or self-adjusts the rate of extension and retraction of the drilling element 154 based on or in response to a force or pressure applied to the drilling element 154 during drilling. In some embodiments, the actuation device 156 and drilling element 154 may be actuated by contact of the drilling element 154 with the formation 118. In some drilling operations, substantial forces may be experienced on the drilling elements 154 when a depth of cut ("DOC") of the drill bit 116 is changed rapidly. Accordingly, the actuation device 156 may be configured to resist sudden changes to the DOC of the drill bit 116. In some embodiments, the rate of extension and retraction of the drilling element 154 may be preset, as described in more detail in reference to FIGS. 2-5.

Figure 2:
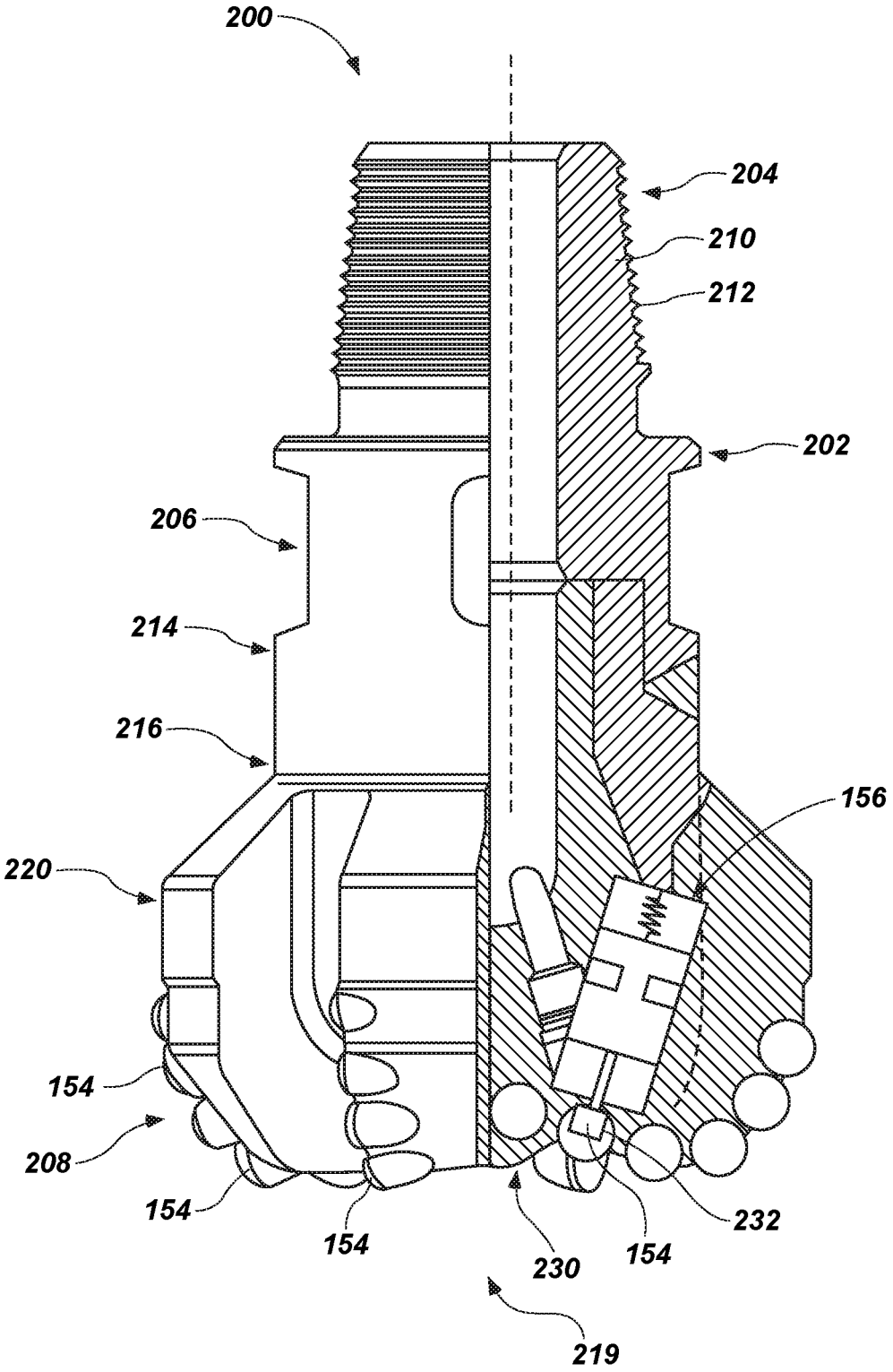
FIG. 2 is a partial cross-sectional view of a self-adjusting drill bit according to an embodiment of the present disclosure.

FIG. 2 shows an earth-boring tool 200 having an actuation device 156 according to an embodiment of the present disclosure. In some embodiments, the earth-boring tool 200 includes a fixed-cutter polycrystalline diamond compact (PDC) bit having a bit body 202 that includes a neck 204, a shank 206, and a crown 208. The earth-boring tool 200 may be any suitable drill bit or earth-boring tool for use in drilling and/or enlarging a wellbore in a formation.

The neck 204 of the bit body 202 may have a tapered upper end 210 having threads 212 thereon for connecting the earth-boring tool 200 to a box end of the drilling assembly 114 (FIG. 1). The shank 206 may include a lower straight section 214 that is fixedly connected to the crown 208 at a joint 216. The crown 208 may include a number of blades 220. Each blade 220 may have multiple regions as known in the art (cone, nose, shoulder, gage).

The earth-boring tool 200 may include one or more cutting, wear, or bearing elements 154 (referred to hereinafter as "drilling elements 154") that extend and retract from a surface 230 of the earth-boring tool 200. For example, the bit body 202 of the earth-boring tool 200 may carry (e.g., have attached thereto) a plurality of drilling elements 154. As shown in FIG. 2, the drilling element 154 may be movably disposed in a cavity or recess 232 in the crown 208. An actuation device 156 may be coupled to the drilling element 154 and may be configured to control rates at which the drilling element 154 extends and retracts from the earth-boring tool 200 relative to a surface 230 of the earth-boring tool 200. In some embodiments, the actuation device 156 may be oriented with a longitudinal axis of the actuation device 156 oriented at an acute angle (e.g., a tilt) relative to a direction of rotation of the earth-boring tool 200 in order to minimize a tangential component of a friction force experienced by the actuation device 156. In some embodiments, the actuation device 156 may be disposed inside the blades 220 supported by the bit body 202 and may be secured to the bit body 202 with a press fit proximate a face 219 of the earth-boring tool 200. In some embodiments, the actuation device 156 may be disposed within a gage region of a bit body 202. For example, the actuation device 156 may be coupled to a gage pad and may be configured to control rates at which the gage pad extends and retracts from the gage region of the bit body 202. For example, the actuation device 156 may be disposed within a gage region similar to the actuation devices described in U.S. patent application Ser. No. 14/516,069, to Jain, the disclosure of which is incorporated in its entirety herein by this reference.

Figure 3:
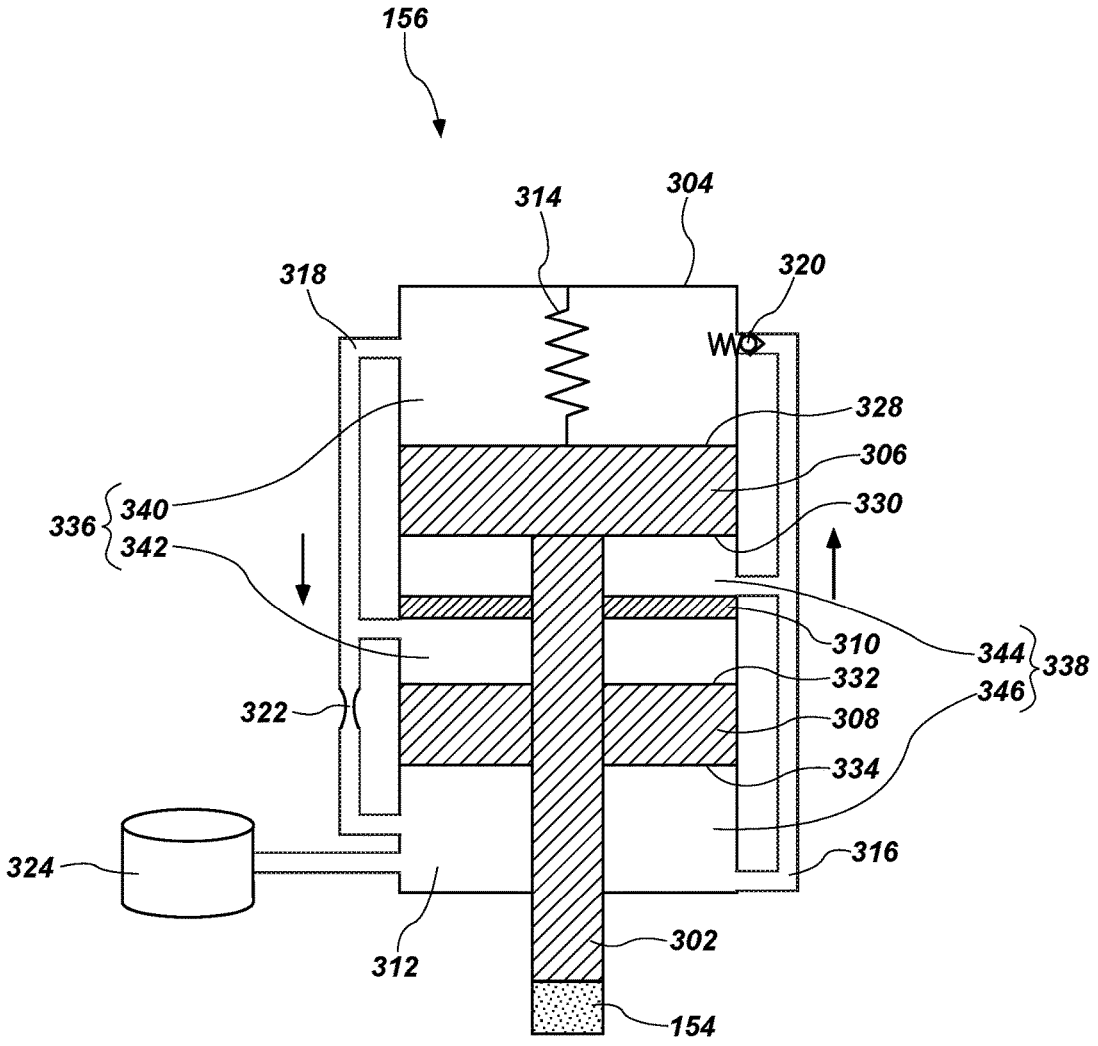
FIG. 3 is a schematic representation of an actuation device of a self-adjusting drill bit according to an embodiment of the present disclosure.

FIG. 3 shows a schematic view of an actuation device 156 of a self-adjusting earth-boring tool 200 (FIG. 2) according to an embodiment of the present disclosure. The actuation device 156 may include a connection member 302, a chamber 304, a first reciprocating member 306, a second reciprocating member 308, a divider member 310, a hydraulic fluid 312, a biasing member 314, a first fluid flow path 316, a second fluid flow path 318, a first flow control device 320, a second flow control device 322, a pressure compensator 324, and a drilling element 154.

The first reciprocating member 306 and the second reciprocating member 308 may be attached to the connection member 302 at different locations along a longitudinal axis of the connection member 302. For example, the first reciprocating member 306 may be attached to a first longitudinal end of the connection member 302, and the second reciprocating member 308 may be attached to a portion of the connection member 302 axially between the first longitudinal end and a second longitudinal end of the connection member 302. The drilling element 154 may be attached to the second longitudinal end of the connection member 302. In some embodiments, the first reciprocating member 306 may have a generally cylindrical shape, and the second reciprocating member 308 may have a generally annular shape. The first reciprocating member 306 may have a front surface 328 and an opposite back surface 330, and the second reciprocating member 308 have a front surface 332 and an opposite back surface 334. As used herein, a "front surface" of a reciprocating member may refer to a surface of the reciprocating member that, if subjected to a force, will result in the reciprocating member moving the connection member 302 outward toward a formation 118 (FIG. 1) (e.g., at least partially out of the chamber 304). For example, the front surface 328 of the first reciprocating member 306 may be a surface of the first reciprocating member 306 opposite the connection member 302. Furthermore, as used herein, a "back surface" of a reciprocating member may refer to a surface of the reciprocating member that, if subjected to a force, will result in the reciprocating member moving the connection member 302 inward and further into the chamber 304. For example, the back surface 330 of the first reciprocating member 306 may be a surface of the first reciprocating member 306 that is attached to the connection member 302.

The front surface 328 of the first reciprocating member 306 may be at least substantially parallel to the front surface 332 of the second reciprocating member 308. Furthermore, the back surface 330 of the first reciprocating member 306 may be at least substantially parallel to the back surface 334 of the second reciprocating member 308.

The chamber 304 may be sealingly divided by the first and second reciprocating members 306, 308 (e.g., pistons) and the divider member 310 into a first fluid chamber 336 and a second fluid chamber 338. The first fluid chamber 336 may include a first portion 340 and a second portion 342. Furthermore, the second fluid chamber 338 may have a first portion 344 and a second portion 346. The first portion 340 of the first fluid chamber 336 may be sealingly isolated from the first portion 344 of the second fluid chamber 338 by the first reciprocating member 306. The first portion 340 of the first fluid chamber 336 may be located on a front side of the first reciprocating member 306. In other words, the first portion 340 of the first fluid chamber 336 may be at least partially defined by the front surface 328 of the first reciprocating member 306. The first portion 344 of the second fluid chamber 338 may be located on a back side of the first reciprocating member 306. In other words, the first portion 344 of the second fluid chamber 338 may be at least partially defined by the back surface 330 of the first reciprocating member 306.

The first portion 344 of the second fluid chamber 338 may be isolated from the second portion 342 of the first fluid chamber 336 by the divider member 310. The divider member 310 may be stationary relative to the first portion 344 of the second fluid chamber 338 and the second portion 342 of the first fluid chamber 336. For example, the first portion 344 of the second fluid chamber 338 may be located between the back surface 330 of the first reciprocating member 306 and the divider member 310. The second portion 342 of the first fluid chamber 336 may be sealingly divided from the second portion 346 of the second fluid chamber 338 by the second reciprocating member 308. For example, the second portion 342 of the first fluid chamber 336 may be located on a front side of the second reciprocating member 308 (e.g., at least partially defined by the front surface 332 of the second reciprocating member 308), and the second portion 346 of the second fluid chamber 338 may be located on a back side of the second reciprocating member 308 (e.g., at least partially defined by the back surface 334 of the second reciprocating member 308). Furthermore, the second portion 342 of the first fluid chamber 336 may be located between the divider member 310 and the front surface 332 of the second reciprocating member 308.

As a result of the orientations described above, the portions (i.e., the first and second portions of each) of first and second fluid chambers 336, 338 may be oriented in parallel (e.g., stacked) within the chamber 304. Put another way, the portions (i.e., the first and second portions of each) of first and second fluid chambers 336, 338 may be oriented parallel to each other along a longitudinal length of the actuation device 156.

The first fluid chamber 336 and a second fluid chamber 338 may be at least substantially filled with the hydraulic fluid 312. The hydraulic fluid 312 may include any hydraulic fluid 312 suitable for downhole use, such as oil. In some embodiments, the hydraulic fluid 312 may include one or more of a magneto-rheological fluid and an electro-rheological fluid.

In some embodiments, the first and second fluid chambers 336, 338 and may be in fluid communication with each other via the first fluid flow path 316 and the second fluid flow path 318. For example, the first fluid flow path 316 may allow hydraulic fluid 312 to flow from the second fluid chamber 338 to the first fluid chamber 336. The first fluid flow path 316 may extend from the second portion 346 of the second fluid chamber 338 to the first portion 340 of the first fluid chamber 336 and may allow the hydraulic fluid 312 to flow from the second portion 346 of the second fluid chamber 338 to the first portion 340 of the first fluid chamber 336. Furthermore, the first fluid flow path 316 may extend from the first portion 344 of the second fluid chamber 338 to the first portion 340 of the first fluid chamber 336 and may allow the hydraulic fluid 312 to flow from the first portion 344 of the second fluid chamber 338 to the first portion 340 of the first fluid chamber 336.

The first flow control device 320 may be disposed within the first fluid flow path 316 and may be configured to control the flow rate of the hydraulic fluid 312 from the second fluid chamber 338 to the first fluid chamber 336. In some embodiments, the first flow control device 320 may include one or more of a first check valve and a first restrictor (e.g., an orifice). In some embodiments, the first flow control device 320 may include only a first check valve. In other embodiments, the first flow control device 320 may include only a first restrictor. In other embodiments, the first flow control device 320 may include both the first check valve and the first restrictor.

The second fluid flow path 318 may allow the hydraulic fluid 312 to flow from the first fluid chamber 336 to the second fluid chamber 338. For example, the second fluid flow path 318 may extend from the first portion 340 of the first fluid chamber 336 to the second portion 346 of the second fluid chamber 338 and may allow the hydraulic fluid 312 to flow from the first portion 340 of the first fluid chamber 336 to the second portion 346 of the second fluid chamber 338. Furthermore, the second fluid flow path 318 may extend from the second portion 342 of the first fluid chamber 336 to the second portion 346 of the second fluid chamber 338 and may allow the hydraulic fluid 312 to flow from the second portion 342 of the first fluid chamber 336 to the second portion 346 of the second fluid chamber 338. The second flow control device 322 may be disposed within the second fluid flow path 318 and may be configured to control the flow rate of the hydraulic fluid 312 from the first fluid chamber 336 to the second fluid chamber 338 (i.e., from the first and second portions 340, 342 of the first fluid chamber 336 to the second portion 346 of the second fluid chamber 338). In some embodiments, the second flow control device 322 may include one or more of a second check valve and a second restrictor (e.g., orifice). In some embodiments, the second flow control device 322 may include only a second check valve. In other embodiments, the second flow control device 322 may include only a second restrictor. In other embodiments, the second flow control device 322 may include both the second check valve and the second restrictor.

As discussed above, the connection member 302 may be connected at the first longitudinal end thereof to the back surface 330 of the first reciprocating member 306, which faces the first portion 344 of the second fluid chamber 338. Furthermore, as discussed above, the connection member 302 may be connected to the drilling element 154 at a second, opposite longitudinal end of the connection member 302. The biasing member 314 (e.g., a spring) may be disposed within the first portion 340 of the first fluid chamber 336 and may be attached to the first reciprocating member 306 on the front surface 328 of the first reciprocating member 306 opposite the connection member 302 and may exert a force on the first reciprocating member 306 and may move the first reciprocating member 306, and as a result, the connection member 302 outward toward a formation 118 (FIG. 1). For example, the biasing member 314 may move the first reciprocating member 306 outward, which may in turn move the connection member 302 and the drilling element 154 outward (i.e., extend the drilling element 154). Such movement of the first reciprocating member 306, connection member 302, and drilling element 154 may be referred to herein as an "outward stroke." As the first reciprocating member 306 moves outward, the first reciprocating member 306 may expel hydraulic fluid 312 from the first portion 344 of the second fluid chamber 338, through the first fluid flow path 316, and into the first portion 340 of the first fluid chamber 336.

As discussed above, the second reciprocating member 308 may also be attached to the connection member 302 but may be attached to a portion of the connection member 302 axially between the first longitudinal end connected to the first reciprocating member 306 and the second longitudinal end connected to the drilling element 154. For example, the second reciprocating member 308 may have a generally annular shape and the connection member 302 may extend through the second reciprocating member 308. Additionally, the second reciprocating member 308 may be spaced by at least some distance from the first reciprocating member 306 along the longitudinal axis of the connection member 302. Furthermore, because the second reciprocating member 308 is attached to the connection member 302, which is attached to the first reciprocating member 306, when the first reciprocating member 306 moves outward due to the biasing member 314, the second reciprocating member 308 moves outward. In other words, the force applied on the first reciprocating member 306 by the biasing member 314 may result in the second reciprocating member 308 moving outward in addition to the first reciprocating member 306 moving outward. As the second reciprocating member 308 moves outward, the second reciprocating member 308 may expel hydraulic fluid 312 from the second portion 346 of the second fluid chamber 338, through the first fluid flow path 316, and into the first portion 340 of the first fluid chamber 336.

In some embodiments, the second fluid chamber 338 may be at a pressure at least substantially equal to an environment pressure, and the first fluid chamber 336 may be at a pressure higher than the pressure of the second fluid chamber 338. For example, the first fluid chamber 336 may be at a pressure higher than the pressure of the second fluid chamber 338 when the connection member 302 is being subjected to an external load (e.g., the drilling element 154 is pushing against a formation 118 (FIG. 1)) The pressure differential between the first fluid chamber 336 and the second fluid chamber 338 may assist in applying a selected force on the first reciprocating member 306 and the second reciprocating member 308 and moving the first and second reciprocating members 306, 308, and as a result, the connection member 302 and the drilling element 154 through the outward stroke. For example, the first portion 340 of the first fluid chamber 336, which is in fluid communication with the front surface 328 of the first reciprocating member 306, may be at a higher pressure than a pressure of the first portion 344 of the second fluid chamber 338, which is in fluid communication with the back surface 330 of the first reciprocating member 306. The pressure differential between the first portion 340 of the first fluid chamber 336 and the first portion 344 of the second fluid chamber 338 may assist in applying a selected force on the front surface 328 of the first reciprocating member 306. Furthermore, the second portion 342 of the first fluid chamber 336, which is in fluid communication with the front surface 332 of the second reciprocating member 308, may be at a higher pressure than a pressure of the second portion 346 of the second fluid chamber 338, which is in fluid communication with the back surface 334 of the second reciprocating member 308. The pressure differential between the second portion 342 of the first fluid chamber 336 and the second portion 346 of the second fluid chamber 338 may assist in applying a selected force on the front surface 332 of the second reciprocating member 308.

Because both of the first and second portions 340, 342 of the first fluid chamber 336 are at a higher pressure than the first and second portions 344, 346 of the second fluid chamber 338 and are located at different locations along the longitudinal axis of the connection member 302, an overall force applied by the pressure of the first fluid chamber 336 may be applied in portions at different locations (i.e., the first and second reciprocating members 306, 308) along the longitudinal axis of the connection member 302.

Having the first and second portions 340, 342 of the first fluid chamber 336 at a higher pressure than the first and second portions 344, 346 of the second fluid chamber 338 and distributed along a longitudinal length of the connection member 302 may enable a cross-sectional area of the overall actuation device 156 to be smaller than an actuation device 156 having a single fluid chamber at high pressure. Furthermore, having the first and second portions 340, 342 of the first fluid chamber 336 at a higher pressure and distributed along a longitudinal length of the connection member 302 may enable the cross-sectional area of the overall actuation device 156 to be smaller while maintaining a same force on the connection member 302. For example, because the higher pressure is applied to the front surfaces 328, 332 of both of the first and second reciprocating members 306, 308, a surface area of the front surfaces 328, 332 of each of the first and second reciprocating members 306, 308 may be smaller while applying a selected force than if there were only a single larger reciprocating member. Furthermore, a same selected force may be applied to the connection member 302 by the two smaller reciprocating members as is applied with the single larger reciprocating member. In other words, by having two reciprocating members, the front surface of each of the reciprocating members may have a smaller surface area than otherwise would be needed with a single reciprocating member to apply the selected force on the connection member 302. Put another way, the pressure of the first fluid chamber 336 may be divided between and applied to two surface areas (i.e., the front surfaces 328, 332 of the first and second reciprocating members 306, 308) that are at least substantially parallel to each other. Put yet another way, the first and second reciprocating members 306, 308 may provide a sufficient surface area between the two front surfaces 328, 332 of the first and second reciprocating members 306, 308, which is in fluid communication with the hydraulic fluid 312 in the first fluid chamber 336 (e.g., hydraulic fluid 312 at a higher pressure) to withstand (e.g., handle, carry, absorb, dampen) loads (e.g., forces) that the connection member 302 and first and second reciprocating members 306, 308 may be subjected to during use in a drilling operation in a wellbore 102 (FIG. 1).

As a result of the above, an overall cross-sectional area of the actuation device 156 may be smaller than an actuation device 156 having a single reciprocating member, and the actuation device 156 may apply a same force with the pressure of the first fluid chamber 336 to the connection member 302 as the actuation device 156 having a single reciprocating member.

Referring to FIGS. 1, 2 and 3 together, reducing a cross-sectional area of the actuation device 156 needed to apply a selected force to the connection member 302 of the actuation device 156 or withstand (e.g., absorb, endure, tolerate, bear, etc.) a force applied to the connection member 302 by a formation 118 (FIG. 1) may provide advantages over other known self-adjusting drill bits. For example, by reducing the cross-sectional area of the actuation device 156, a space required to house the actuation device 156 is also reduced. Accordingly, the actuation device 156 may be disposed in more types and sizes of bit bodies 202. For example, the actuation device 156 may be disposed within smaller bit bodies 202 than would otherwise be achievable with known actuation devices. Furthermore, by requiring less space, the actuation device 156 may be placed in more locations within a bit body 202. Moreover, by requiring less space, more drilling elements 154 of a bit body 202 may be attached to actuation devices 156. Additionally, by requiring less space, the actuation device 156 may be less likely to compromise a structural integrity of the bit body 202. Consequently, the given bit body 202 may be used in more applications and may have increased functionality. Although the actuation device 156 is described herein as being used with a bit body 202 or drill bit, the actuation device 156 is equally applicable to reamers, impact tools, hole openers, etc.

In some embodiments, the second fluid chamber 338 may be maintained at a pressure at substantially equal to an environment pressure (e.g., pressure outside of earth-boring tool 200 (FIG. 2)) with the pressure compensator 324, which may be in fluid communication with the second fluid chamber 338. For example, one or more of the first or second portions 344, 346 of the second fluid chamber 338 may be in fluid communication with the pressure compensator 324. The pressure compensator 324 may include a bellows, diaphragm, pressure compensator 324 valve, etc. For example, the pressure compensator 324 may include a diaphragm that is in fluid communication with the environment (e.g., mud of wellbore 102 (FIG. 1)) on one side and in fluid communication with the hydraulic fluid 312 in the second fluid chamber 338 on another side and may at least substantially balance the pressure of the second fluid chamber 338 with the environment pressure. In some embodiments, the pressure compensator 324 may comprise a rubber material. For example, the pressure compensator 324 may include a rubber diaphragm. Including a pressure compensator 324 may reduce a required sealing pressure for mud seals and oil seals included in the actuation device 156.

Referring still to FIG. 3, during operation, when the drilling element 154 contacts the formation 118 (FIG. 1), the formation 118 (FIG. 1) may exert a force on the drilling element 154, which may move the connection member 302 and, as a result, the first and second reciprocating members 306, 308 inward. Moving the first reciprocating member 306 inward may expel the hydraulic fluid 312 from the first portion 340 of the first fluid chamber 336, through the second fluid flow path 318, and into the second portion 346 of the second fluid chamber 338. Furthermore, moving the second reciprocating member 308 inward may expel hydraulic fluid 312 from the second portion 342 of the first fluid chamber 336, through the second fluid flow path 318, and into the second portion 346 of the second fluid chamber 338. Pushing hydraulic fluid 312 from the first and second portions 340, 342 of the first fluid chamber 336 into the second portion 346 of the second fluid chamber 338 may move the drilling element 154 inward (i.e., retract the drilling element 154). Such movement of the first and second reciprocating members 306, 308 and drilling element 154 may be referred to herein as an "inward stroke."

The rate of the movement of the first and second reciprocating members 306, 308 (e.g., the speed at which the first and second reciprocating members 306, 308 moves through the outward and inward strokes) may be controlled by the flow rates of the hydraulic fluid 312 through the first and second fluid flow paths 316, 318, and the first and second flow control devices 320, 322. As a result, the rate of the movement of the drilling element 154 (e.g., the speed at which drilling element 154 extends and retracts) and the position of the drilling element 154 relative to the surface 230 (FIG. 2) may be controlled by the flow rates of the hydraulic fluid 312 through the first and second fluid flow paths 316, 318, and the first and second flow control devices 320, 322.

In some embodiments, the flow rates of the hydraulic fluid 312 through the first and second fluid flow paths 316, 318 and, as result, between the first and second fluid chambers 336, 338 may be at least partially set by selecting hydraulic fluids 312 with viscosities that result in the desired flow rates. In some embodiments, the flow rates of the hydraulic fluid 312 through the first and second fluid flow paths 316, 318 may be at least partially set by selecting flow control devices that result in the desired flow rates. Furthermore, the hydraulic fluid 312, specifically, a viscosity of a hydraulic fluid 312, may be selected to increase or decrease an effectiveness of the first and second flow control devices 320, 322.

As a non-limiting example, the first and second flow control devices 320, 322, may be selected to provide a slow outward stroke (i.e., slow flow rate of the hydraulic fluid 312 through the first fluid flow path 316) of the drilling element 154 and a fast inward stroke of the drilling element 154 (i.e., a fast flow rate of the hydraulic fluid 312 through the second fluid flow path 318). For example, a first restrictor may be disposed in the first fluid flow path 316 to provide a slow outward stroke, and a first check valve may be disposed in the second fluid flow path 318 to provide a fast inward stroke. In other embodiments, the first and second flow control devices 320, 322, may be selected to provide a fast outward stroke of the drilling element 154 and a slow inward stroke of the drilling element 154. For example, a second check valve may be disposed in the first fluid flow path 316 to provide a fast outward stroke, and a second restrictor may be disposed in the second fluid flow path 318 to provide a slow inward stroke.

In some embodiments, the viscosities of the hydraulic fluid 312 and the first and second flow control devices 320, 322 may be selected to provide constant fluid flow rate exchange between the first fluid chamber 336 and the second fluid chamber 338. Constant fluid flow rates may provide a first constant rate for the extension for the connection member 302 and a second constant rate for the retraction of the connection member 302 and, thus, corresponding constant rates for extension and retraction of the drilling element 154. In some embodiments, the flow rate of the hydraulic fluid 312 through the first fluid flow path 316 may be set such that when the earth-boring tool 200 (FIG. 2) is not in use, i.e., there is no external force being applied onto the drilling element 154, the biasing member 314 will extend the drilling element 154 to a maximum extended position. In some embodiments, the flow rate of the hydraulic fluid 312 through the first fluid flow path 316 may be set so that the biasing member 314 extends the drilling element 154 relatively fast or suddenly.

In some embodiments, the flow rates of the hydraulic fluid 312 through the second fluid flow path 318 may be set to allow a relatively slow flow rate of the hydraulic fluid 312 from the first fluid chamber 336 into the second fluid chamber 338, thereby causing the drilling element 154 to retract relative to the surface 230 (FIG. 2) relatively slowly. For example, the extension rate of the drilling element 154 may be set so that the drilling element 154 extends from the fully retracted position to a fully extended position over a few seconds or a fraction of a second while it retracts from the fully extended position to the fully retracted position over one or several minutes or longer (such as between 2-5 minutes). It will be noted, that any suitable rate may be set for the extension and retraction of the drilling element 154. Thus, the earth-boring tool 200 (FIG. 2) may act as a self-adjusting drill bit such as the self-adjusting drill bit described in U.S. Pat. App. Pub. No. 2015/0191979 A1, to Jain et al., filed Oct. 6, 2014, the disclosure of which is incorporated in its entirety herein by this reference.

In other embodiments, the actuation device 156 may include rate controllers as described in the U.S. application Ser. No. 14/851,117, to Jain, filed Sep. 11, 2015, the disclosure of which is incorporated in its entirety herein by this reference. For example, the actuation device 156 may include one or more rate controllers that are configured to adjust fluid properties (e.g., viscosities) of the hydraulic fluid 312, and thereby, control flow rates of the hydraulic fluid 312 through the first and second flow control devices 320, 322. As a non-limiting example, the rate controllers may include electromagnets and the hydraulic fluid 312 may include a magneto-rheological fluid. The electromagnets may be configured to adjust the viscosity of the hydraulic fluid 312 to achieve a desired flow rate of the hydraulic fluid 312, and as a result, a rate of extension or retraction of the drilling element 154.

Furthermore, in some embodiments, one or more of the first and second flow control devices 320, 322 may include a restrictor as described in the U.S. application Ser. No. 14/851,117, to Jain, filed Sep. 11, 2015. For example, the restrictor may include a multi-stage orifice having a plurality of plates, a plurality of orifices extending through each plate of the plurality of plates, and a plurality of fluid pathways defined in each plate of the plurality of plates and surrounding each orifice of the plurality of orifices.

Figure 4:
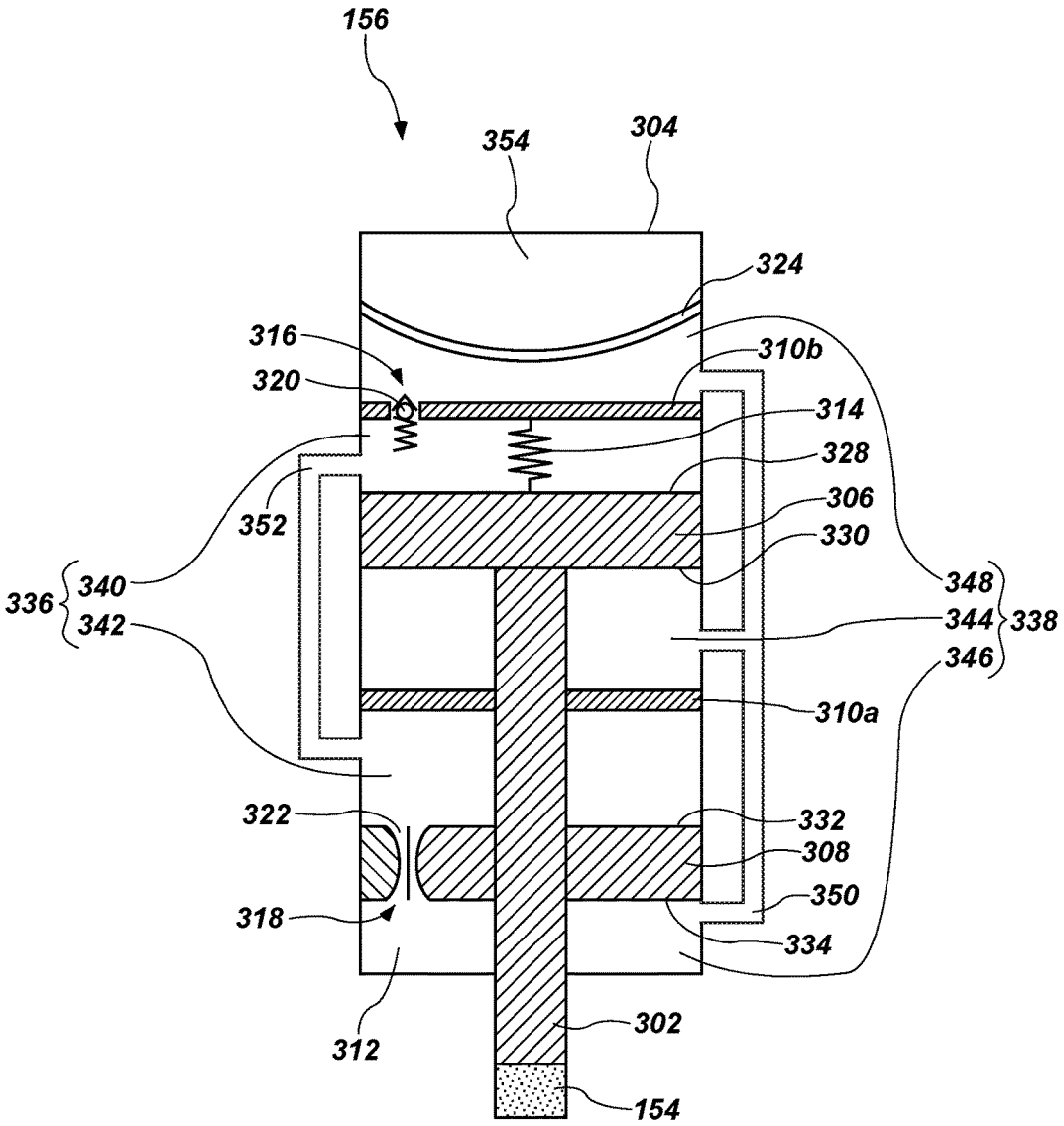
FIG. 4 is a schematic representation of an actuation device of a self-adjusting drill bit according to another embodiment of the present disclosure.

FIG. 4 is a schematic view of an actuation device 156 for a self-adjusting earth-boring tool 200 (FIG. 2) according to another embodiment of the present disclosure. Similar to the actuation device 156 described above in regard to FIG. 3, the actuation device 156 of FIG. 4 may include a connection member 302, a chamber 304, a first reciprocating member 306, a second reciprocating member 308, a hydraulic fluid 312, a biasing member 314, a first fluid flow path 316, a second fluid flow path 318, a first flow control device 320, a second flow control device 322, a pressure compensator 324, and a drilling element 154. Furthermore, the chamber 304 may include a first fluid chamber 336 and a second fluid chamber 338. The actuation device 156 may operate in substantially the same manner as the actuation device 156 described in regard to FIG. 3.

However, the actuation device 156 may include a first divider member 310*a* and a second divider member 310*b*, and the second fluid chamber 338 may include a first portion 344, a second portion 346, and a third portion 348. The actuation device 156 may also include a third fluid flow path 350 and a fourth fluid flow path 352. The first portion 344 and second portion 346 of the second fluid chamber 338 may be oriented in the same manner as described above in regard to FIG. 3. Furthermore, the first divider member 310*a* may be oriented in the same manner as the divider member 310 described in regard to FIG. 3.

The second divider member 310*b* may be oriented on an opposite side of the first portion 340 of the first fluid chamber 336 than the first reciprocating member 306, and the third portion 348 of the second fluid chamber 338 may be located on an opposite side of the second divider member 310*b* than the first portion 340 of the first fluid chamber 336. In other words, the third portion 348 of the second fluid chamber 338 may be isolated from the first portion 340 of the first fluid chamber 336 by the second divider member 310*b*. The second divider member 310*b* may be stationary relative to the first portion 340 of the first fluid chamber 336 and the third portion 348 of the second fluid chamber 338.

The third portion 348 of the second fluid chamber 338 may be in fluid communication with the pressure compensator 324, and pressure compensator 324 may be configured to at least substantially balance the pressure of the second fluid chamber 338 with the environment pressure of an environment (e.g., mud of the wellbore 102 (FIG. 1)), as discussed above in regard to FIG. 3. In other words, the pressure compensator 324 may help maintain a pressure of the second fluid chamber 338 that is at least substantially equal to the environment pressure. For example, the pressure compensator 324 may be in fluid communication on a first side with the third portion 348 of the second fluid chamber 338 and may be at least partially disposed within the third portion 348 of the second fluid chamber 338. The pressure compensator 324 may include one or more of a bellows, diaphragm, and pressure compensator 324 valve and may be in communication on a second side with an environment (e.g., mud 354 of the wellbore 102 (FIG. 1). In some embodiments, the pressure compensator 324 may comprise a rubber material. For example, the pressure compensator 324 may include a rubber diaphragm.

The first fluid flow path 316 may extend from the third portion 348 of the second fluid chamber 338 to the first portion 340 of the first fluid chamber 336 through the second divider member 310*b*. The first flow control device 320 may be disposed within the first fluid flow path 316 and may include one or more of a first check valve and a first restrictor. Otherwise, the first fluid flow path 316 and first flow control device 320 may operate in the same manner as the first fluid flow path 316 and first flow control device 320 described in regard to FIG. 3.

The second fluid flow path 318 may extend from the second portion 342 of the first fluid chamber 336 to the second portion 346 of the second fluid chamber 338 through the second reciprocating member 308. The second flow control device 322 may be disposed within the second fluid flow path 318 and may include one or more of a second check valve and a second restrictor. Otherwise, the second fluid flow path 318 and second flow control device 322 may operate in the same manner as the second fluid flow path 318 and second flow control device 322 described in regard to FIG. 3.

The first, second, and third portions 344, 346, 348 of the second fluid chamber 338 may be in fluid communication with each other via a third fluid flow path 350. For example, the third fluid flow path 350 may extend from the second portion 346 of the second fluid chamber 338 to the first portion 344 of the second fluid chamber 338 and to the third portion 348 of the second fluid chamber 338.

The first and second portions 340, 342 of the first fluid chamber 336 may be in fluid communication with each other via the fourth fluid flow path 352. For example, the fourth fluid flow path may extend from the first portion 340 of the first fluid chamber 336 to the second portion 342 of the first fluid chamber 336.

Figure 5:
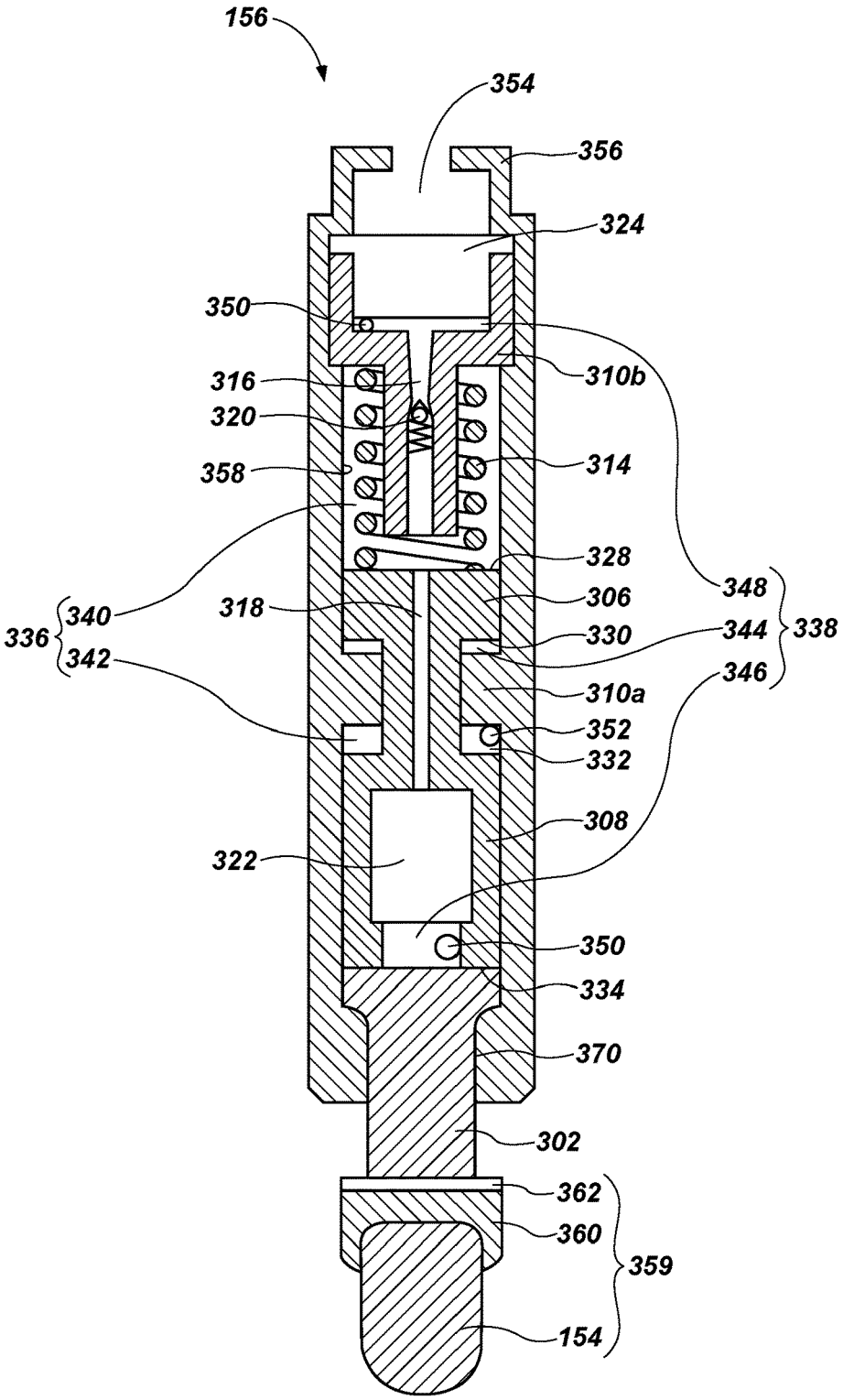
FIG. 5 is a cross-sectional view of an actuation device for a self-adjusting drill bit according to another embodiment of the present disclosure.

FIG. 5 is a cross-sectional view of an example implementation of the actuation device 156 of a self-adjusting bit of FIG. 4. The actuation device 156 may be similar to the actuation device 156 shown in FIG. 4 as described above. The actuation device 156 may be configured to be press fitted into a crown 208 of a bit body 202 (FIG. 2) of an earth-boring tool 200 (FIG. 2). The actuation device 156 may include a casing 356, a connection member 302, an internal chamber 358, a first reciprocating member 306, a second reciprocating member 308, a hydraulic fluid 312, a biasing member 314, a first fluid flow path 316, a second fluid flow path 318, a third fluid flow path 350, a fourth fluid flow path 352, a first divider member 310*a*, a second divider member 310*b*, a first flow control device 320, a second flow control device 322, a pressure compensator 324, and a drilling element 154.

The first reciprocating member 306 and the second reciprocating member 308 may be attached to the connection member 302 in the same manner as described in regard to FIG. 3. The casing 356 may define the internal chamber 358 and may have an extension hole 370 defined in one longitudinal end thereof. Furthermore, the internal chamber 358 may house the first and second reciprocating members 306, 308. Moreover, the first and second reciprocating members 306, 308 and first and second divider members 310*a*, 310*b* may sealingly divide the internal chamber 358 into the first fluid chamber 336 and the second fluid chamber 338.

The first fluid chamber 336 may include a first portion 340 and a second portion 342, and the second fluid chamber 338 may include a first portion 344, a second portion 346, and a third portion 348. The first portion 340 of the first fluid chamber 336 may be sealingly isolated from the first portion 344 of the second fluid chamber 338 by the first reciprocating member 306. The first portion 340 of the first fluid chamber 336 may be located on a front side of the first reciprocating member 306. In other words, the first portion 340 of the first fluid chamber 336 may be at least partially defined by the front surface 328 of the first reciprocating member 306. The first portion 344 of the second fluid chamber 338 may be located on a back side of the first reciprocating member 306. In other words, the first portion 344 of the second fluid chamber 338 may be at least partially defined by the back surface 330 of the first reciprocating member 306.

The first portion 344 of the second fluid chamber 338 may be isolated from the second portion 342 of the first fluid chamber 336 by the first divider member 310*a*. The first divider member 310*a* may be stationary relative to the first portion 344 of the second fluid chamber 338 and the second portion 342 of the first fluid chamber 336. For example, the first portion 344 of the second fluid chamber 338 may be located between the back surface 330 of the first reciprocating member 306 and the first divider member 310*a*. In some embodiments, the first divider member 310*a* may comprise a portion of the casing 356. For example, the first divider may be an annular shape protrusion extending radially inward from the casing 356. The second portion 342 of the first fluid chamber 336 may be sealingly divided from the second portion 346 of the second fluid chamber 338 by the second reciprocating member 308. For example, the second portion 342 of the first fluid chamber 336 may be located on a front side of the second reciprocating member 308 (e.g., at least partially defined by the front surface 332 of the second reciprocating member 308), and the second portion 346 of the second fluid chamber 338 may be located on a back side of the second reciprocating member 308 (e.g., at least partially defined by the back surface 334 of the second reciprocating member 308). The second portion 342 of the first fluid chamber 336 may be located between the first divider member 310*a* and the front surface 332 of the second reciprocating member 308. In some embodiments, the second portion 346 of the second fluid chamber 338 may be at least partially enclosed within the second reciprocating member 308.

The second divider member 310*b* may be oriented on an opposite side of the first portion 340 of the first fluid chamber 336 than the first reciprocating member 306, and the third portion 348 of the second fluid chamber 338 may be located on an opposite side of the second divider member 310*b* than the first portion 340 of the first fluid chamber 336. In other words, the third portion 348 of the second fluid chamber 338 may be isolated from the first portion 340 of the first fluid chamber 336 by the second divider member 310*b*. The second divider member 310*b* may be stationary relative to the first portion 340 of the first fluid chamber 336 and the third portion 348 of the second fluid chamber 338.

The third portion 348 of the second fluid chamber 338 may be in fluid communication with the pressure compensator 324, and pressure compensator 324 may be configured to at least substantially balance the pressure of the second fluid chamber 338 with the environment pressure of an environment (e.g., mud 354 of the wellbore 102 (FIG. 1)), as discussed above in regard to FIG. 3. In other words, the pressure compensator 324 may help maintain a pressure of the second fluid chamber 338 that is at least substantially equal to the environment pressure. For example, the pressure compensator 324 may be in fluid communication on a first side with the third portion 348 of the second fluid chamber 338 and may be at least partially disposed within the third portion 348 of the second fluid chamber 338. The pressure compensator 324 may include one or more of a bellows, diaphragm, and pressure compensator 324 valve and may be in communication on a second side with an environment (e.g., mud 354 of the wellbore 102 (FIG. 1). In some embodiments, the pressure compensator 324 may comprise a rubber material. For example, the pressure compensator 324 may include a rubber diaphragm. The first fluid chamber 336 may have a pressure that is higher than the pressure of the second fluid chamber 338.

As discussed above, the connection member 302 may be attached to the back surface 330 of the first reciprocating member 306 at a first longitudinal end of the connection member 302. The connection member 302 may extend through the first portion 344 of the second fluid chamber 338, the second portion 342 of the first fluid chamber 336, and the second portion 346 of the second fluid chamber 338 and through the extension hole 370 of the casing 356 of the actuation device 156. The drilling element 154 may be attached to a second longitudinal end of the connection member 302 opposite the first end such that that drilling element 154 may be extended and retracted through the extension hole 370 of the external casing 356 of the actuation device 156.

The hydraulic fluid 312 may be disposed within the first fluid chamber 336 and the second fluid chamber 338 and may at least substantially fill the first fluid chamber 336 and the second fluid chamber 338. The biasing member 314 may be disposed within the first portion 340 of the first fluid chamber 336 and may be configured to apply a selected force on the first reciprocating member 306 to cause the first reciprocating member 306 to move through the first portion 344 of the second fluid chamber 338 outwardly (e.g., toward the extension hole 370 of the external casing 356). Furthermore, as discussed above, the pressure differential between the first fluid chamber 336 and the second fluid chamber 338 may assist in moving the first and second reciprocating members 306, 308 outward. As result, the biasing member 314 may cause the connection member 302 and drilling element 154 to move outwardly (e.g., may cause the drilling element 154 to extend). In some embodiments, the biasing member 314 may include a spring.

The first fluid flow path 316 may extend from the third portion 348 of the second fluid chamber 338 to the first portion 340 of the first fluid chamber 336 through the second divider member 310*b*. The first flow control device 320 may be disposed within the first fluid flow path 316. Furthermore, the first flow control device 320 may be configured to control the flow rate of the hydraulic fluid 312 from the third portion 348 of the second fluid chamber 338 to the first portion 340 of the first fluid chamber 336. In some embodiments, the first flow control device 320 may include one or more of a first check valve and a first restrictor. In some embodiments, the first restrictor may include a multi-stage orifice. In some embodiments, the first flow control device 320 may include only the first check valve. In other embodiments, the first flow control device 320 may include only the first restrictor. In other embodiments, the first flow control device 320 may include both the first check valve and the first restrictor.

The second fluid flow path 318 may extend from the first portion 340 of the first fluid chamber 336 to the second portion 346 of the second fluid chamber 338 through the first reciprocating member 306, a portion of the connection member 302, and the second reciprocating member 308. The second fluid flow path 318 may allow the hydraulic fluid 312 to flow from the first portion 340 of the first fluid chamber 336 to the second portion 346 of the second fluid chamber 338. The second flow control device 322 may be disposed within the second fluid flow path 318. Furthermore, the second flow control device 322 may be configured to control the flow rate of the hydraulic fluid 312 from the first portion 340 of the first fluid chamber 336 to the second portion 346 of the second fluid chamber 338. In some embodiments, the second flow control device 322 may include one or more of second check valve and a second restrictor. In some embodiments, the second restrictor may include a multi-stage orifice. In some embodiments, the second flow control device 322 may include only the second check valve. In other embodiments, the second flow control device 322 may include only the second restrictor. In other embodiments, the second flow control device 322 may include both the second check valve and the second restrictor.

The first, second, and third portions 344, 346, 348 of the second fluid chamber 338 may be in fluid communication with each other via the third fluid flow path 350. In some embodiments, the third fluid flow path 350 may include an aperture extending through the casing 356.

The first and second portions 340, 342 of the first fluid chamber 336 may be in fluid communication with each other via the fourth fluid flow path 352. In some embodiments, the third fluid flow path 350 may include an aperture extending through the casing 356.

In some embodiments, the drilling element 154 may be removably attachable to the connection member 302. A drilling element assembly 359 may be removably coupled to the second longitudinal end of the connection member 302. The drilling element assembly 359 may include the drilling element 154, a drilling element seat 360, and a shim 362. The drilling element 154 may be disposed in the drilling element seat 360. The shim 362 may be disposed between the drilling element seat 360 and the second longitudinal end of the connection member 302.

In some embodiments, the drilling element 154, drilling element seat 360, and shim 362 may not be rigidly attached to the connection member 302. For example, as discussed above, the connection member 302 may be under a preload due to the biasing member 314 disposed in the first portion 340 of the first fluid chamber 336, and the biasing member 314 may press the connection member 302 against the shim 362, drilling element seat 360, and drilling element 154. In some embodiments, the drilling assembly 359 may only be in contact with the connection member 302 and the preload due to the biasing member 314 and external loads applied to the connection member 302 during drilling operations may keep the drilling assembly 359 in contact with the connection member 302. In other words, the drilling assembly 359 may not be rigidly coupled to the connection member 302.

Having the drilling element 154 be removably attachable to the connection member 302 may allow the drilling element 154 to be removed and replaced without disassembling the actuation device 156. In other words, the drilling element 154 may be replaced independent of the rest of the actuation device 156. Accordingly, removably attaching the drilling element 154 to the connection member 302 may lead to time and cost savings when replacing drilling elements 154. In some embodiments, both the drilling element 154 and the drilling element seat 360 may be replaced. In other embodiments, just the drilling element 154 may be replaced. Additionally, having the drilling element 154 be removably attachable to the connection member 302 may allow a given actuation device 156 to be used with multiple different drilling elements 154 without requiring disassembly of the actuation device 156. As a result, the removably attachable drilling element 154 provides for a wider variety of drilling elements 154 that be used for a given bit body 202 (FIG. 2) in order to suit particular applications.

The shim 362 may enable the actuation devices 156 to be used in bit bodies 202 (FIG. 2) more universally (e.g., among different cavities in the bit bodies 202 (FIG. 2)). For example, cavities 232 (FIG. 2) in bit bodies 202 (FIG. 2) for holding the actuation devices 156 and drilling elements 154 may have different tolerances and slightly different sizes. Accordingly, by having a shim 362, the actuation devices and drilling elements 154 may be used in more cavities 232 (FIG. 2) of the bit body 202 (FIG. 2) and may be shimmed with the shim 362 to meet specific tolerances.

In some embodiments, the drilling element 154 and the drilling element seat 360 may be removable from the connection member 302. For example, the drilling element 154 and drilling element seat 360 may be removed through heating the drilling element 154 and drilling element seat 360 to a temperature above that of a melting temperature of a brazing material used to attach the drilling element 154 and the drilling element seat 360 to the connection member 302. However, any method known in the art may be used to remove the drilling element 154 and drilling element seat 360 from the connection member 302.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. An earth-boring tool, comprising:
- a body;
- an actuation device disposed at least partially within the body, the actuation device comprising:
  - a first fluid chamber having a first portion and a second portion;
  - a second fluid chamber having a first portion and a second portion;
  - a first reciprocating member configured to reciprocate back and forth within the first portion of the first fluid chamber and the first portion of the second fluid chamber;
  - a second reciprocating member configured to reciprocate back and forth within the second portion of the first fluid chamber and the second portion of the second fluid chamber;
  - a hydraulic fluid disposed within and at least substantially filling the first fluid chamber and the second fluid chamber; and
  - a connection member attached to the first reciprocating member and extending through the second reciprocating member and out of the second portion of the second fluid chamber; and
- a drilling element removably coupled to the connection member of the actuation device.

2. The earth-boring tool of claim 1, wherein the actuation device further comprises:
- a first fluid flow path extending from the second fluid chamber to the first fluid chamber; and
- a first flow control device disposed within the first fluid flow path and configured to control a flow rate of the hydraulic fluid through the first fluid flow path.

3. The earth-boring tool of claim 2, wherein the actuation device further comprises:
- a second fluid flow path extending from the first fluid chamber to the second fluid chamber;
- a second flow control device disposed within the second fluid flow path and configured to control a flow rate of the hydraulic fluid through the second fluid flow path and the second flow control device.

4. The earth-boring tool of claim 3, wherein the second fluid flow path extends from the first fluid chamber to the second fluid chamber through the second reciprocating member.

5. The earth-boring tool of claim 1, wherein the first portion of the first fluid chamber is in fluid communication with a front surface of the first reciprocating member, and wherein the second portion of the first fluid chamber is in fluid communication with a front surface of the second reciprocating member.

6. The earth-boring tool of claim 1, wherein the first portion of the second fluid chamber is in fluid communication with a back surface of the first reciprocating member, and wherein the second portion of the second fluid chamber is in fluid communication with a back surface of the second reciprocating member.

7. The earth-boring tool of claim 1, wherein a pressure of the second fluid chamber is at least substantially equal to an ambient environment pressure to which the earth-boring tool is exposed.

8. The earth-boring tool of claim 7, wherein a pressure of the first fluid chamber is higher than the pressure of the second fluid chamber when the connection member is subjected to an external force.

9. The earth-boring tool of claim 1, wherein the actuation device further comprises a biasing member disposed within the first fluid chamber and configured to exert a force on the first reciprocating member.

10. An earth-boring tool, comprising:
- a body;
- an actuation device disposed at least partially within the body, the actuation device comprising:
  - a first reciprocating member disposed within an upper portion of the actuation device and configured to reciprocate back and forth within the upper portion of the actuation device;
  - a second reciprocating member disposed within a lower portion of the actuation device and configured to reciprocate back and forth within the lower portion of the actuation device; and
  - a connection member attached to the first reciprocating member, extending through the second reciprocating member, and extending out of the actuation device; and
- a drilling element assembly removably coupled to a longitudinal end of the connection member extending out of the actuation device.

11. The earth-boring tool of claim 10, wherein the actuation device further comprises a pressure compensator configured to at least substantially balance a pressure within the actuation device with an ambient environment pressure to which the earth-boring tool is exposed.

12. The earth-boring tool of claim 11, wherein the pressure compensator comprises a rubber material.

13. The earth-boring tool of claim 12, wherein the drilling element assembly comprises:
- a drilling element seat;
- a drilling element disposed within the drilling element seat; and
- a shim disposed between the longitudinal end of the connection member and the drilling element seat.

14. The earth-boring tool of claim 10, wherein the first reciprocating member is spaced apart from the second reciprocating member by at least some distance along a longitudinal length of the actuation device.

15. The earth-boring tool of claim 14, wherein the actuation device comprises:
- a first fluid chamber having a first portion in fluid communication with a front surface of the first reciprocating member and a second portion in fluid communication with a front surface of the second reciprocating member; and
- a second fluid chamber having a first portion in fluid communication with a back surface of the first reciprocating member and a second portion in fluid communication with a back surface of the second reciprocating member.

16. The earth-boring tool of claim 10, wherein the first reciprocating member has an at least generally cylindrical shape and wherein the second reciprocating member has an at least generally annular shape.

17. The earth-boring tool of claim 16, wherein the connection member is attached to a back surface of the first reciprocating member.

18. An actuation device for a self-adjusting earth-boring tool, the actuation device comprising:

a first fluid chamber having a first portion and a second portion;

a second fluid chamber having a first portion and a second portion;

a first reciprocating member sealingly dividing the first portion of the first fluid chamber from the first portion of the second fluid chamber;

a second reciprocating member sealingly dividing the second portion of the second fluid chamber from the second portion of the first fluid chamber;

a connection member attached to a back surface of the first reciprocating member facing the first portion of the second fluid chamber, the connection member further attached to and extending through the second reciprocating member and out of the second portion of the second fluid chamber;

a pressure compensator in fluid communication with the second fluid chamber; and a drilling element attached to the connection member.

19. The actuation device of claim 18, wherein the pressure compensator comprises a rubber material.

20. The actuation device of claim 18, further comprising a biasing member configured to apply a force to a front surface of the first reciprocating member opposite the back surface.

* * * * *